US010118076B2

(12) United States Patent
Whalen et al.

(10) Patent No.: US 10,118,076 B2
(45) Date of Patent: Nov. 6, 2018

(54) PERFORMANCE GOLF TEE

(71) Applicants: Ronald Whalen, Port Charlotte, FL (US); Daniel Whalen, Clermont, FL (US)

(72) Inventors: Ronald Whalen, Port Charlotte, FL (US); Daniel Whalen, Clermont, FL (US)

( * ) Notice: Subject to any disclaimer, the term of this patent is extended or adjusted under 35 U.S.C. 154(b) by 0 days.

(21) Appl. No.: 15/927,804

(22) Filed: Mar. 21, 2018

(65) Prior Publication Data

US 2018/0280773 A1 Oct. 4, 2018

Related U.S. Application Data

(60) Provisional application No. 62/477,832, filed on Mar. 28, 2017.

(51) Int. Cl.
*A63B 57/19* (2015.01)

(52) U.S. Cl.
CPC ..... *A63B 57/19* (2015.10)

(58) Field of Classification Search
CPC ..... A63B 57/10; A63B 57/12; A63B 57/13; A63B 57/15; A63B 57/16; A63B 57/18; A63B 57/19
USPC ..... D21/717
See application file for complete search history.

(56) References Cited

U.S. PATENT DOCUMENTS

| | | | | | |
|---|---|---|---|---|---|
| 2,455,705 | A * | 12/1948 | Seager | A63B 57/10 | 273/DIG. 2 |
| 4,192,504 | A * | 3/1980 | Clugage | A63B 57/10 | 473/257 |
| 4,516,773 | A * | 5/1985 | Martin | A63B 57/10 | 366/343 |
| 5,193,803 | A * | 3/1993 | Flick, III | A63B 57/10 | 473/392 |
| 6,004,228 | A * | 12/1999 | Adam | A63B 57/10 | 473/403 |
| 8,403,776 | B1 * | 3/2013 | Gruenwald | A63B 57/10 | 473/387 |
| 9,849,360 | B2 * | 12/2017 | Carroll, Jr. | A63B 57/10 | |
| 2004/0204268 | A1 * | 10/2004 | Hsien | A63B 57/10 | 473/396 |
| 2006/0199669 | A1 * | 9/2006 | Barouh | A63B 57/10 | 473/398 |
| 2007/0129177 | A1 * | 6/2007 | Harris | A63B 57/10 | 473/387 |
| 2008/0039238 | A1 * | 2/2008 | Lee | A63B 57/12 | 473/400 |

(Continued)

*Primary Examiner* — Steven Wong

(57) ABSTRACT

A performance golf tee is a support for a golf ball to offset the golf ball from a ground surface. The performance golf tee includes a tee shaft, a ball mounting support, a ground insertion spike and a directional indicator. The ball mounting support is connected to the tee shaft to support a golf ball on a front support extrusion and a pair of rear support extrusions. The front support extrusion and the pair of rear support extrusions reduce friction by offsetting the golf ball from the remainder of the ball mounting support. The ground insertion spike is connected to the tee shaft, opposite to the ball mounting support, to allow the present invention to more efficiently penetrate the ground surface. The directional indicator indicates the orientation of the performance golf tee to optimally reduce friction when the golf ball is struck.

9 Claims, 8 Drawing Sheets

(56) References Cited

U.S. PATENT DOCUMENTS

| | | | | |
|---|---|---|---|---|
| 2009/0191983 | A1* | 7/2009 | Otsubo | A63B 57/10<br>473/396 |
| 2013/0012332 | A1* | 1/2013 | Leyva | A63B 57/10<br>473/266 |
| 2014/0128180 | A1* | 5/2014 | Imai | A63B 57/0018<br>473/403 |
| 2015/0051021 | A1* | 2/2015 | Duncan | A63B 69/0075<br>473/396 |
| 2016/0166898 | A1* | 6/2016 | Dastrup | A63B 57/19<br>473/402 |

* cited by examiner

PERFORMANCE GOLF TEE

The current application claims a priority to the U.S. Provisional Patent application Ser. No. 62/477,832 filed on Mar. 28, 2017.

FIELD OF THE INVENTION

The present invention relates generally to a golf tee. More specifically, the present invention is a unique golf tee, specially designed to allow a golfer to place the tee in a certain orientation to reduce the friction from the tee on the ball when the ball is struck.

BACKGROUND OF THE INVENTION

Traditional golf tees comprise a 360-homogeneous design. This design allows a golfer to insert the golf tee into the ground and position a golf ball in any orientation. While the golf tee is designed to raise the golf ball from a ground surface, the traditional golf tee still imparts a frictional force onto the golf ball when the user hits the golf ball with a golf club. The frictional force slightly reduces the velocity or negatively impacts the trajectory of the golf ball as the user strikes the golf ball. By reducing the frictional force imparted onto the golf ball, the golf ball will travel farther and more accurately.

Therefore, it is an objective of the present invention to provide users with a novel golf tee that allows the golfer to place the tee in a certain orientation to reduce the friction in the direction the golf ball will be hit. The present invention reduces the surface area of the golf ball that is in contact with a ball mounting support, in order to limit the frictional forces imparted to the golf ball as the golf ball is struck with a golf club. The present invention includes a directional indicator to ensure the user places the present invention in the proper orientation that optimally reduces the frictional forces.

DETAIL DESCRIPTIONS OF THE INVENTION

All illustrations of the drawings are for the purpose of describing selected versions of the present invention and are not intended to limit the scope of the present invention.

The present invention is a performance golf tee. The present invention reduces the contact area between the golf ball and the present invention in comparison to a traditional golf tee. The reduced contact area reduces the applicable friction from the golf tee onto the golf ball when struck by the user with a golf club.

Figure 1:
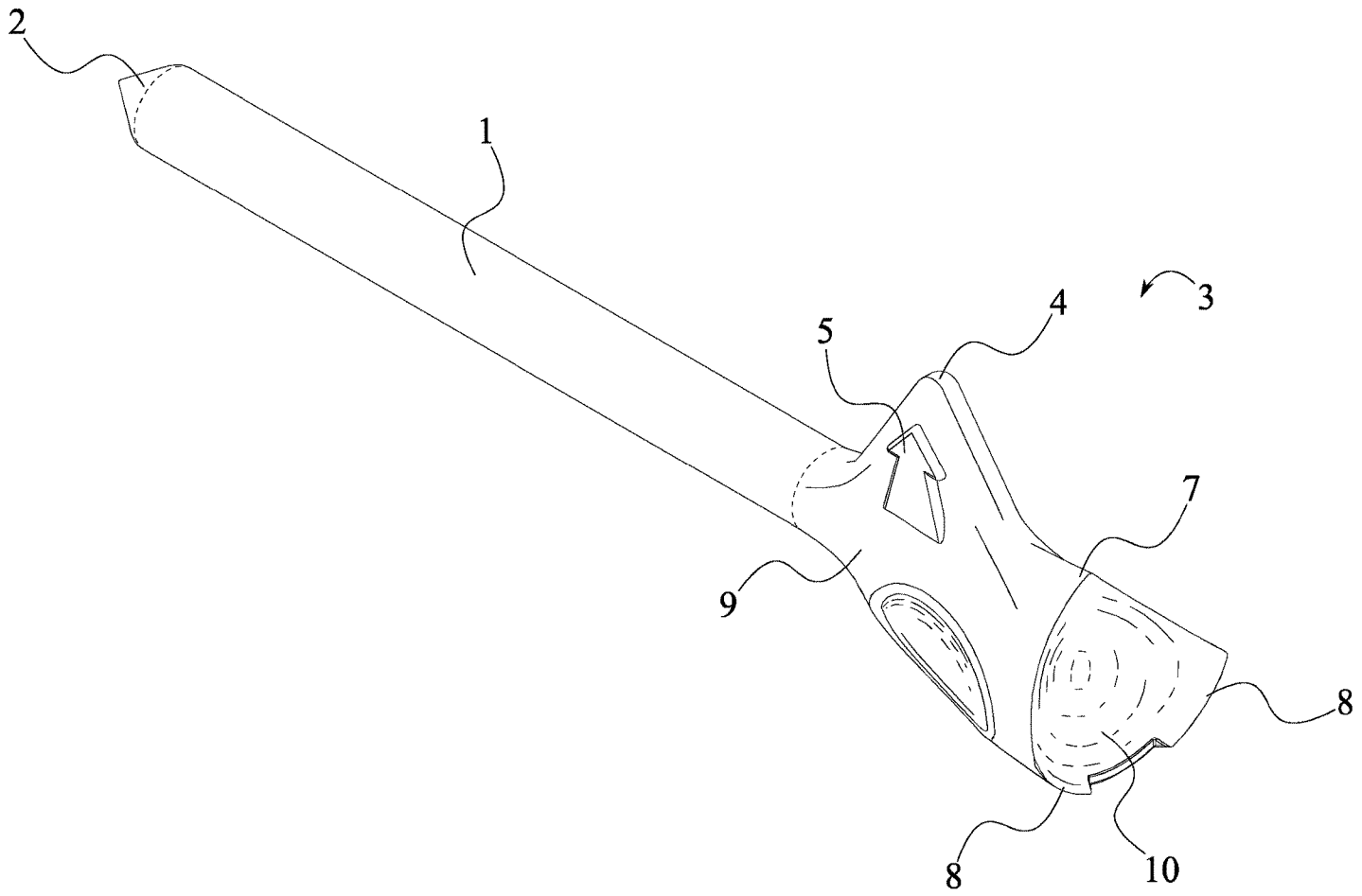
FIG. 1 is a perspective view of the present invention.

In accordance to FIG. 1, the present invention comprises a tee shaft 1, a ground insertion spike 2, a ball mounting support 3, and a directional indicator 4. The tee shaft 1 supports the ball mounting support 3 and the directional indicator 4 as the user inserts the present invention into the ground during implementation of the present invention. The ground insertion spike 2 allows the tee shaft 1 to be more easily inserted into the ground, as the ground insertion spike 2 penetrates at the ground surface to allow the tee shaft 1 to be better positioned into the ground. The ball mounting support 3 supports a golf ball during implementation of the present invention. The ball mounting support 3 comprises a front support extrusion 7, a pair of rear support extrusions 8, a mounting support base 9, and a concave recess 10. The front support extrusion 7 and the pair of rear support extrusions 8 are in direct contact with support the golf ball to support the golf ball as the user is ready to strike the golf ball. The mounting support base 9 connects the front support extrusion 7 and the pair of rear support extrusions 8. The mounting support base 9 is terminally connected to the tee shaft 1 in order to support and offset a golf ball from the ground. The ground insertion spike 2 is terminally connected to the tee shaft 1, opposite the mounting support base 9, to allow the tee shaft 1 to be inserted into the ground efficiently. The ground insertion spike 2 tapers to a point away from the tee shaft 1 to allow the present invention to penetrate the ground surface. The directional indicator 4 is laterally connected to the mounting support base 9 adjacent to the tee shaft 1, in order to denote the direction that the golf ball is intended to be projected. The concave recess 10 provides a space for the curvature of the golf ball to be suspended in as the golf ball is positioned onto the front support extrusion 7 and the pair of rear support extrusions 8. The concave recess 10 traverses into the mounting support base 9. The concave recess 10 is oppositely positioned to the ground insertion spike 2 about the mounting support base 9, to create the void space that a portion of the golf ball is positioned within during implementation. The front support extrusion 7 and the pair of rear support extrusions 8 are connected to the mounting support base 9. The front support extrusion 7 and the pair of rear support extrusions 8 are perimetrically connected around the concave recess 10 to support and offset the golf ball from the mounting support base 9.

Figure 2:
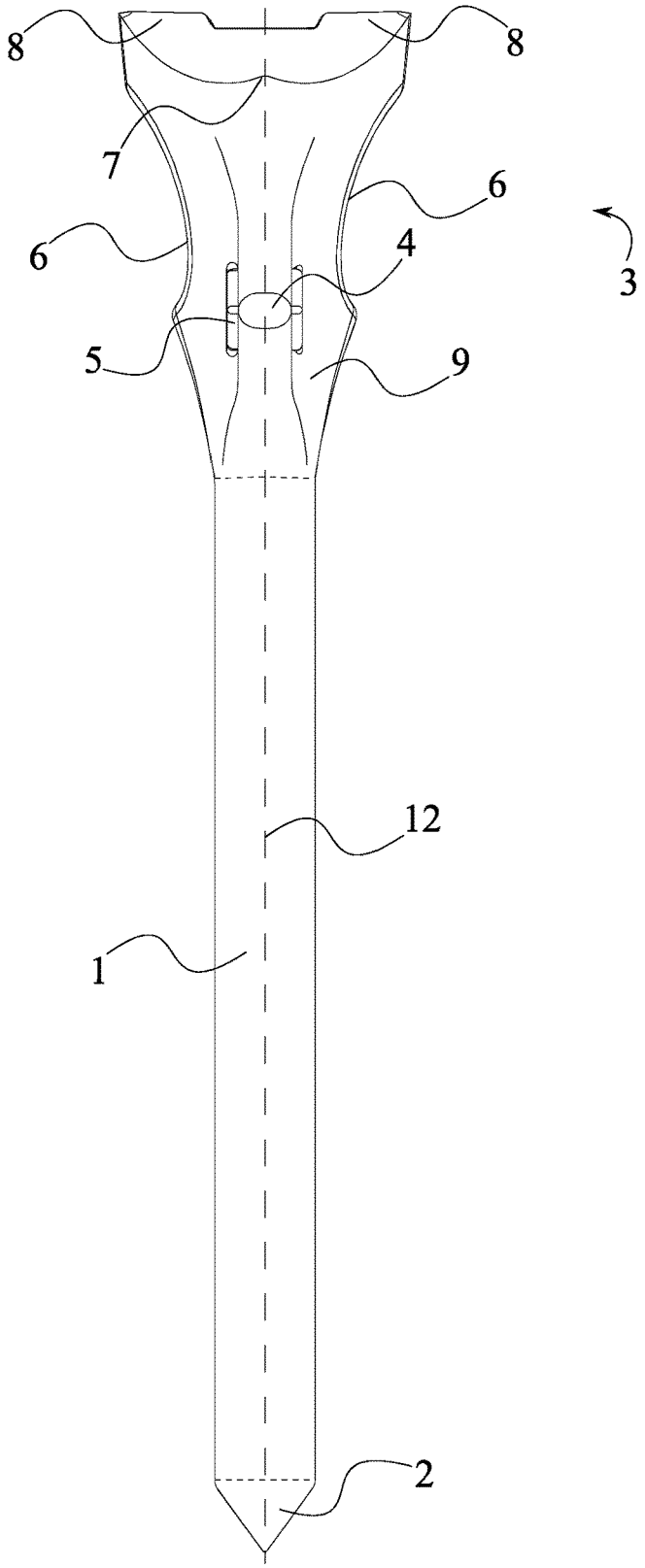
FIG. 2 is a front view of the present invention.
Figure 3:
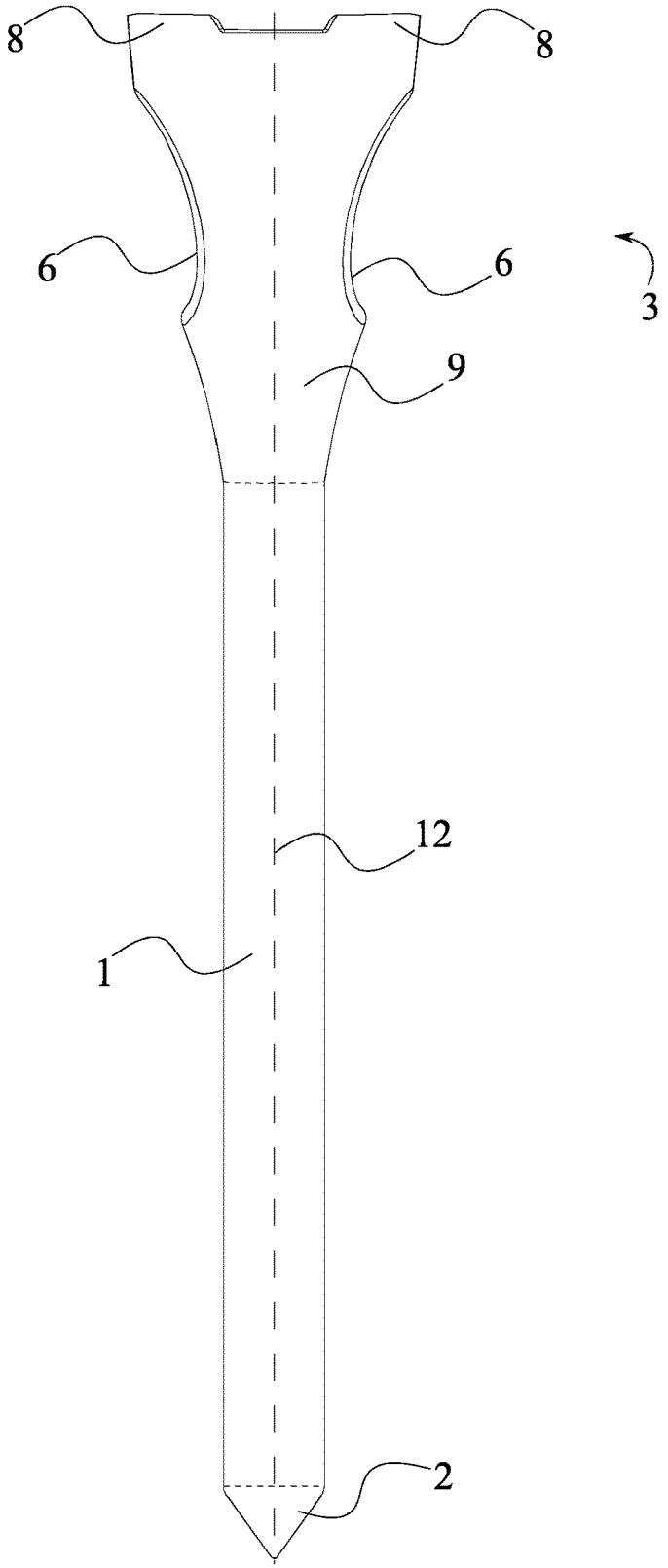
FIG. 3 is a rear view of the present invention.
Figure 4:
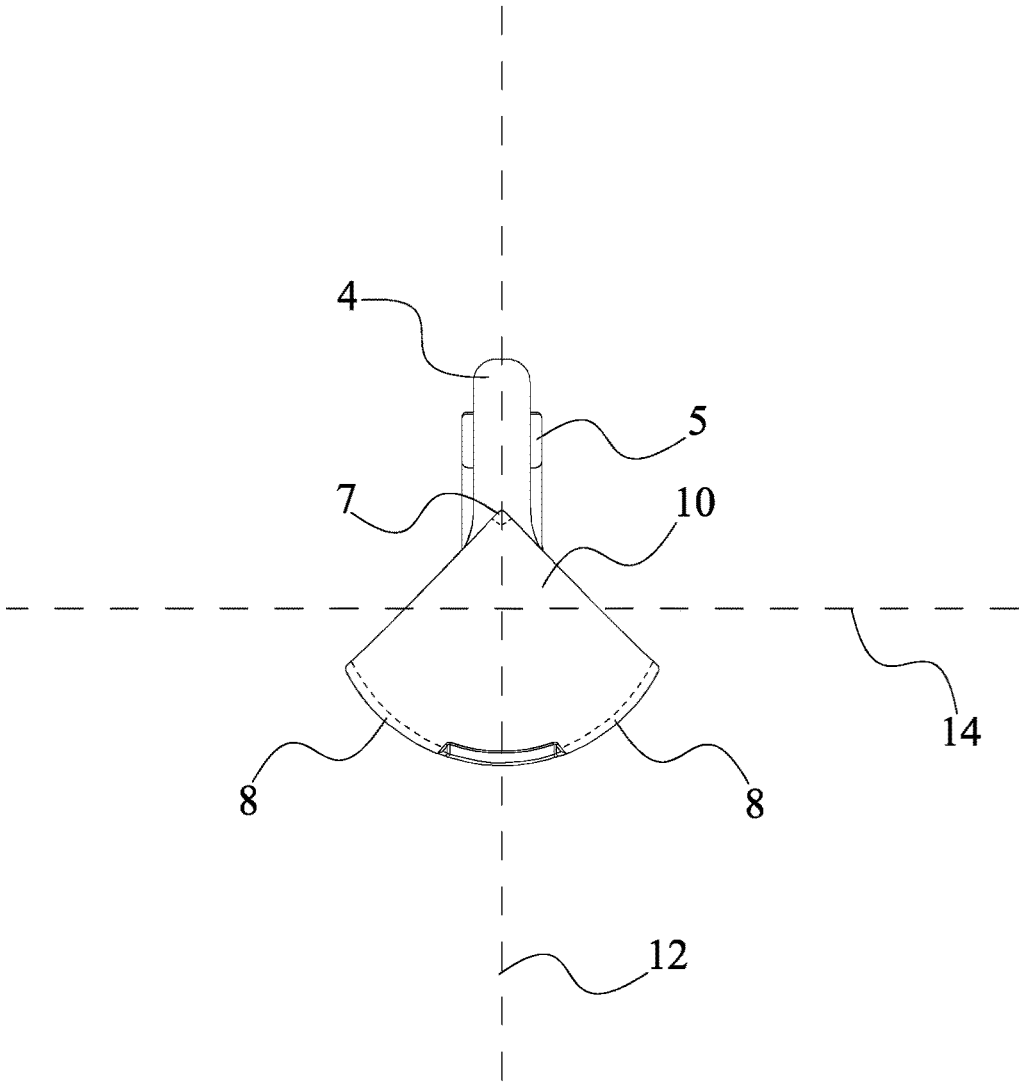
FIG. 4 is a top view of the present invention.
Figure 6:
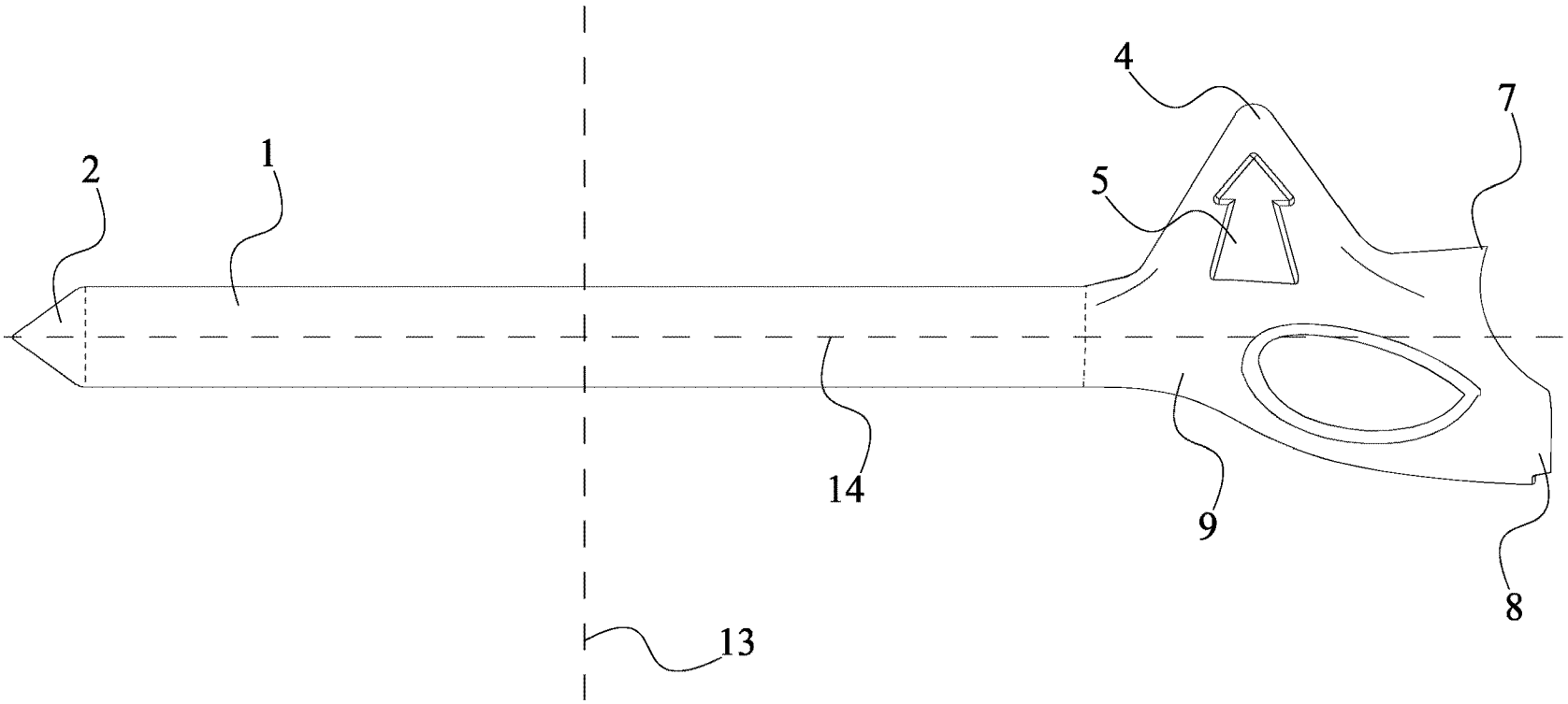
FIG. 6 is a left view of the present invention.
Figure 7:
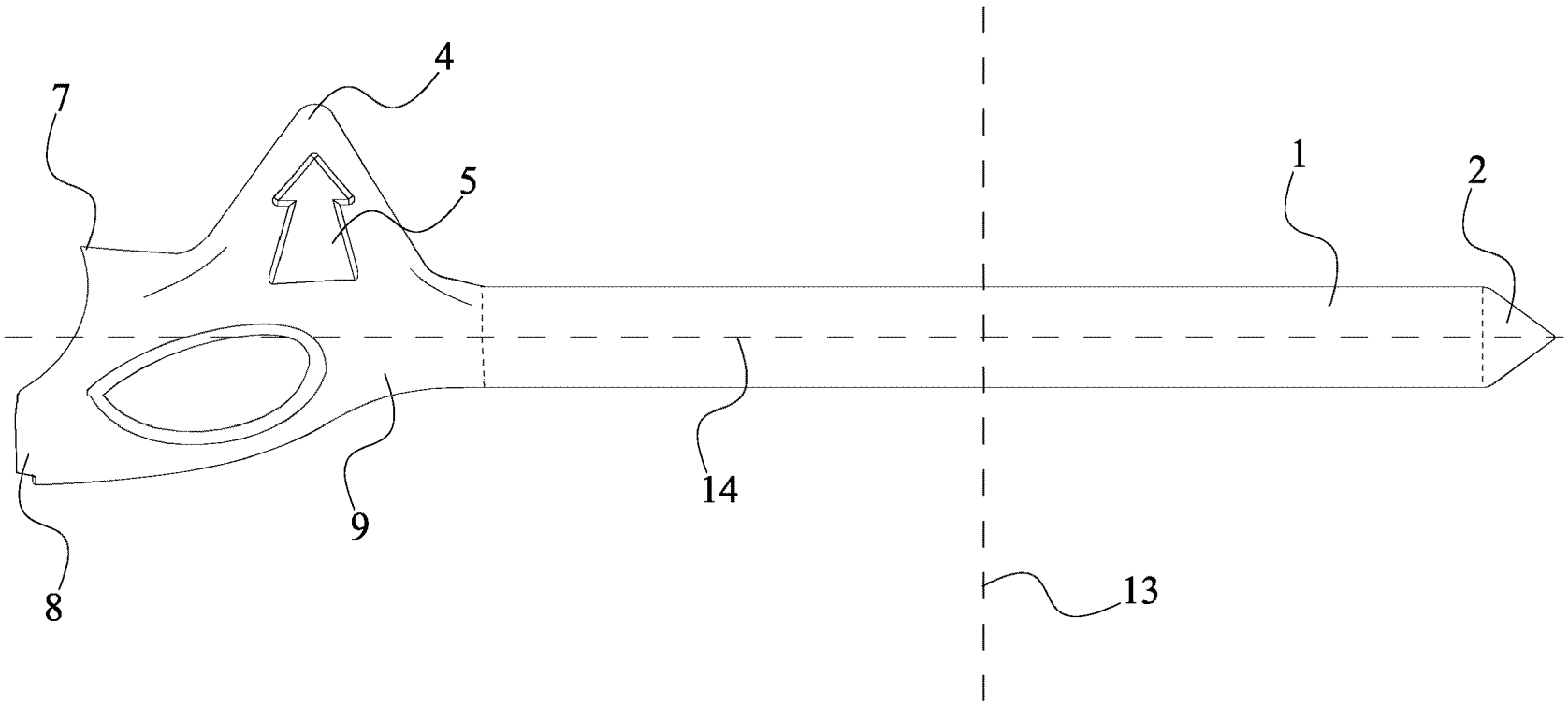
FIG. 7 is a right view of the present invention.

In accordance to the preferred embodiment of the present invention, the front support extrusion 7 is positioned along a sagittal plane 12 of the tee shaft 1, shown in FIG. 2 and FIG. 4. The pair of rear support extrusions 8 is offset from the sagittal plane 12. The pair of rear support extrusions 8 is oppositely positioned to each other about the sagittal plane 12, detailed in FIG. 2 to FIG. 4. The front support extrusion 7 is positioned closer to an axial plane 13 of the tee shaft 1 than the pair of rear support extrusion 8, shown in FIG. 6 to FIG. 8. The front support extrusion 7 is positioned closer to a coronal plane 14 of the tee shaft than the pair of rear support extrusions 8, detailed in FIG. 4 and FIG. 8. This configuration allows the ball mounting support 3 to conform to the curvature of a golf ball while supporting the golf ball.

The front support extrusion 7 is preferred to be adjacently positioned with the directional indicator 4, along the sagittal plane 12. Further, the front support extrusion 7 is oriented in the same direction as the directional indicator 4, in accordance to FIG. 2, FIG. 4 and FIG. 6 to FIG. 8. In this configuration, the user is able to readily identify the direction to orient the present invention and is intended to be positioned to optimally reduce friction between the present invention and the golf ball as the ball is struck in the direction of the directional indicator 4.

Further in accordance to the preferred embodiment of the present invention, the present invention comprises an orientation extrusion 5, shown in FIG. 1, FIG. 2, and FIG. 4 to FIG. 7. The orientation extrusion 5 is an additional visual or tactile aid to the user to indicate the proper direction to orient the present invention. The orientation extrusion 5 traverses out from the directional indicator 4. The orientation extrusion 5 is oriented in the same direction as the directional indicator 4 to indicate the proper orientation of the present invention during implementation.

Still in accordance to the preferred embodiment of the present invention, the pair of rear support extrusions 8 is oppositely positioned to the front support extrusion 7 about the coronal plane 14, shown in FIG. 4 and FIG. 6 to FIG. 8. Further, each of the pair of rear support extrusions 8 is perimetrically offset from the other about the concave recess 10, detailed in FIG. 1 and FIG. 4. In this configuration, the front support extrusion 7 and the pair of rear support extrusions 8 distribute the weight of the golf ball across each of the rear support extrusions. This configuration further reduces the friction between the present invention and the golf ball as the front support extrusion 7 is the only contact point for friction to occur in the direction of travel from hitting the ball adjacent to the pair of rear support extrusions 8.

Figure 8:
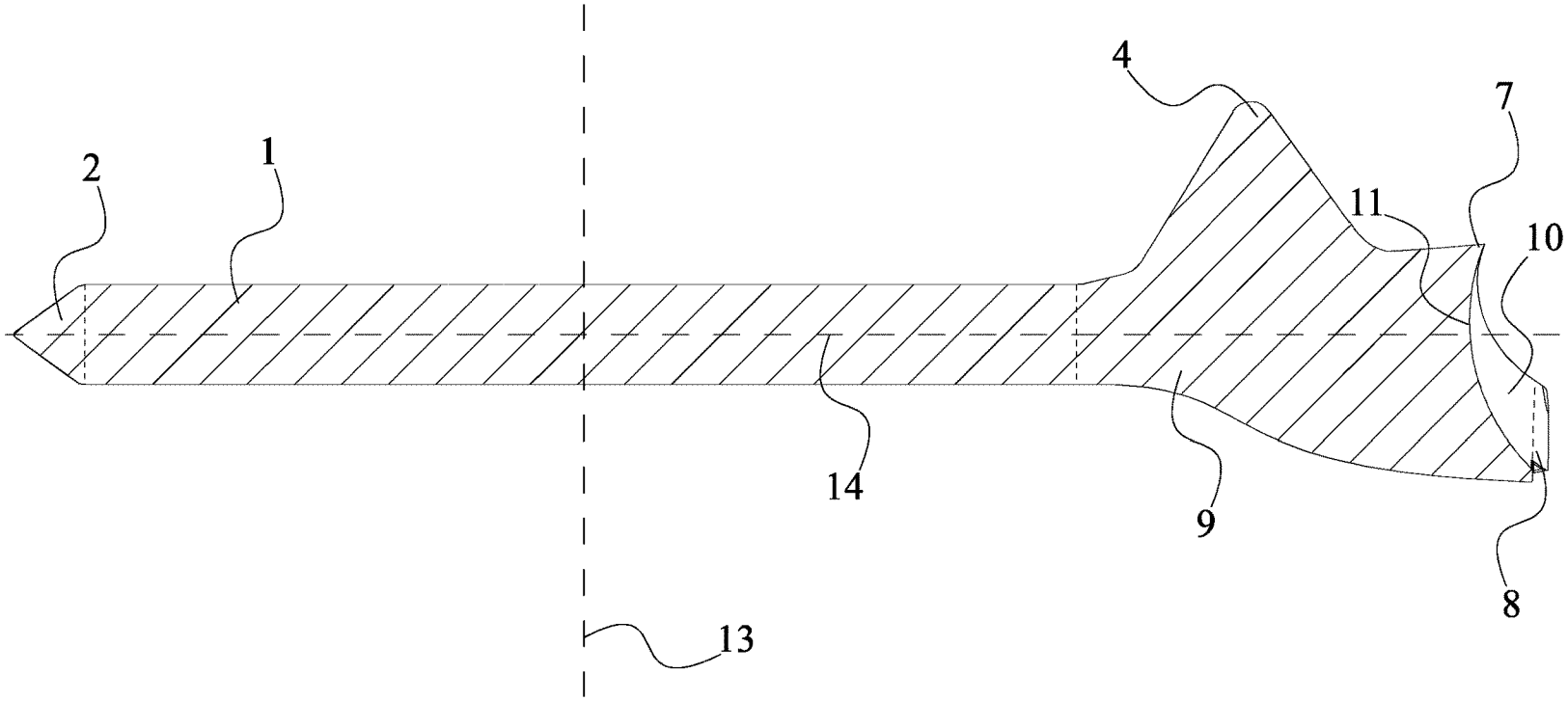
FIG. 8 is a cross-sectional view of the present invention, along a sagittal plane of the tee shaft.

In some embodiments of the present invention, a local minimum 11 of the concave recess 10 is concentrically positioned with the tee shaft 1, in accordance to FIG. 8. The position of the local minimum 11 allows for the center of mass of the golf ball to be positioned over the tee shaft 1, off center from the midpoint of the ball mounting support 3 towards the directional indicator 4. Positioning the center of mass of the golf ball over the tee shaft 1 prevents the golf ball from being dislodged from the present invention.

Figure 5:
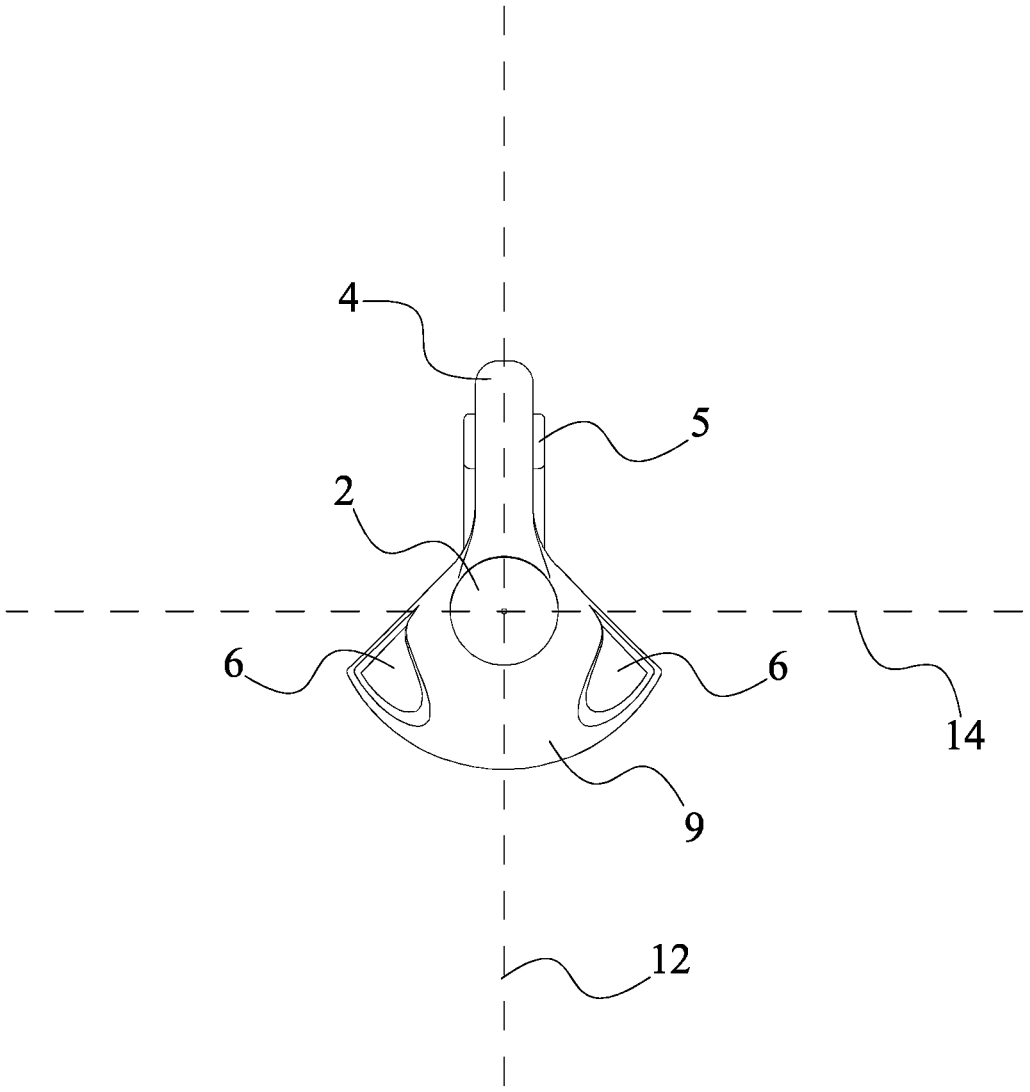
FIG. 5 is a bottom view of the present invention.

Further in accordance to the preferred embodiment of the present invention, the present invention comprises a pair of gripping recesses 6, shown in FIG. 2, FIG. 3, and FIG. 5. The user utilizes the pair of gripping recesses 6 to increase control of the present invention when inserting the present invention into the ground. The pair of gripping recesses 6 traverses into the mounting support base 9. The pair of gripping recesses 6 is positioned between the concave recess 10 and the tee shaft 1. As a golf ball is placed onto the front support extrusion 7 and the pair of rear support extrusions 8, the pair of gripping recesses 6 receive the user's fingers to allow the user to comfortably hold the golf ball to the present invention as the user applies force onto the golf ball to force the present invention into the ground. The directional indicator 4 is positioned between each of the pair of gripping recesses 6 such that the directional indicator 4 does not interfere with the user's fingers as the user grips the present invention.

Although the invention has been explained in relation to its preferred embodiment, it is to be understood that many other possible modifications and variations can be made without departing from the spirit and scope of the invention as hereinafter claimed.

What is claimed is:

1. A performance golf tee comprises:

a tee shaft;

a ground insertion spike;

a ball mounting support;

a directional indicator;

the ball mounting support comprises a front support extrusion, a pair of rear support extrusions, a mounting support base, and a concave recess;

the mounting support base being terminally connected to the tee shaft;

the ground insertion spike being terminally connected to the tee shaft, opposite the mounting support base;

the directional indicator being laterally connected to the mounting support base adjacent to the tee shaft;

the concave recess traversing into the mounting support base;

the concave recess being oppositely positioned to the ground insertion spike about the mounting support base;

the front support extrusion and the pair of rear support extrusions being connected to the mounting support base;

the front support extrusion and the pair of rear support extrusions being perimetrically connected around the concave recess;

the front support extrusion being positioned along a sagittal plane of the tee shaft;

the pair of rear support extrusions being offset from the sagittal plane;

the pair of rear support extrusions being oppositely positioned to each other about the sagittal plane;

the front support extrusion being positioned closer to an axial plane of the tee shaft than the pair of rear support extrusions; and the front support extrusion being positioned closer to a coronal plane of the tee shaft than the pair of rear support extrusions.

2. The performance golf tee, as claimed in claim 1, comprises:

the front support extrusion being adjacently positioned with the directional indicator.

3. The performance golf tee, as claimed in claim 1, comprises:

the front support extrusion being oriented in the same direction as the directional indicator.

4. The performance golf tee, as claimed in claim 1, comprises:

an orientation extrusion; and the orientation extrusion traversing out from the directional indicator.

5. The performance golf tee, as claimed in claim 4, comprises:

the orientation extrusion being oriented in the same direction as the directional indicator.

6. The performance golf tee, as claimed in claim 1, comprises:

the pair of rear support extrusions being oppositely positioned to the front support extrusion about a coronal plane.

7. The performance golf tee, as claimed in claim 1, comprises:

each of the pair of rear support extrusions being perimetrically offset from the other about the concave recess.

8. The performance golf tee, as claimed in claim 1, comprises:

a local minimum of the concave recess being concentrically positioned with the tee shaft.

9. The performance golf tee, as claimed in claim 1, comprises:

a pair of gripping recesses;

the pair of griping recesses traversing into the mounting support base;

the pair of gripping recesses being positioned between the concave recess and the tee shaft; and the directional indicator being positioned between the pair of gripping recesses.

* * * * *